US008066006B2

(12) United States Patent
Daugaard et al.

(10) Patent No.: US 8,066,006 B2
(45) Date of Patent: Nov. 29, 2011

(54) FILTERING FACE-PIECE RESPIRATOR HAVING NOSE CLIP MOLDED INTO THE MASK BODY

(75) Inventors: Dwayne D. Daugaard, Hudson, WI (US); Daniel J. Stepan, Woodbury, MN (US); Yonas Gebrewold, Woodbury, MN (US); Michael K. Domroese, Woodbury, MN (US); Lance E. Behymer, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 580 days.

(21) Appl. No.: 12/238,737

(22) Filed: Sep. 26, 2008

(65) Prior Publication Data

US 2009/0090364 A1 Apr. 9, 2009

Related U.S. Application Data

(60) Provisional application No. 60/978,431, filed on Oct. 9, 2007.

(51) Int. Cl.
*A62B 18/02* (2006.01)
*A62B 7/10* (2006.01)
*A62B 23/02* (2006.01)

(52) U.S. Cl. ..... 128/206.16; 128/205.27; 128/205.29; 128/206.21

(58) Field of Classification Search ..... 128/206.21, 128/206.12, 206.16, 201.25, 201.23, 201.18, 128/205.25, 206.24, 206.28, 207.13
See application file for complete search history.

(56) References Cited

U.S. PATENT DOCUMENTS

| | | | |
|---|---|---|---|
| 1,502,450 | A | 7/1924 | Wood |
| 2,371,965 | A | 3/1945 | Lehmberg |
| 3,603,315 | A | 9/1971 | Becker, III |
| 3,750,665 | A | 8/1973 | Stranicky |
| 4,248,220 | A | 2/1981 | White |
| D267,985 | S | 2/1983 | Huber |
| 4,454,881 | A | 6/1984 | Huber et al. |
| 4,536,440 | A | 8/1985 | Berg |
| 4,600,002 | A | 7/1986 | Maryyanek et al. |
| D285,374 | S | 8/1986 | Huber et al. |
| 4,739,755 | A | 4/1988 | White et al. |
| 4,807,619 | A | 2/1989 | Dyrud et al. |

(Continued)

FOREIGN PATENT DOCUMENTS

CN 2157795 3/1994

(Continued)

OTHER PUBLICATIONS

Moldex 2200 Series N95 Particulate Respirators web page literature [retrieved from the internet on Jul. 19, 2007] http://www.moldex.com/disposableprod/1100n95.htm.

(Continued)

*Primary Examiner* — Justine Yu
*Assistant Examiner* — Valerie L Skorupa
(74) *Attorney, Agent, or Firm* — Karl G. Hanson

(57) ABSTRACT

A filtering face-piece respirator 10 that comprises a mask body 12 and a harness 14. The mask body 12 includes (i) a filtering structure 18, (ii) a plastic support structure 16, and (iii) a nose clip 19 that is secured to the plastic support structure 18 by being molded therein. The inventive filtering face-piece respirator is beneficial in that it eliminates the need for an adhesive or welding step to secure the nose clip to the mask body.

18 Claims, 2 Drawing Sheets

U.S. PATENT DOCUMENTS

| | | | | |
|---|---|---|---|---|
| 4,850,347 | A | 7/1989 | Skov | |
| 4,873,972 | A | 10/1989 | Magidson et al. | |
| 5,050,594 | A | 9/1991 | Babb | |
| 5,307,796 | A | 5/1994 | Kronzer et al. | |
| 5,558,089 | A | 9/1996 | Castiglione | |
| 5,673,690 | A | 10/1997 | Tayebi et al. | |
| D412,573 | S | 8/1999 | Castiglione | |
| 6,012,164 | A | 1/2000 | Deal, III | |
| 6,041,782 | A | 3/2000 | Angadjivand et al. | |
| 6,394,090 | B1 | 5/2002 | Chen | |
| 6,474,336 | B1 | 11/2002 | Wolfe | |
| 6,484,722 | B2 | 11/2002 | Bostock et al. | |
| 6,568,392 | B1 | 5/2003 | Bostock et al. | |
| 6,571,797 | B1 | 6/2003 | Magidson et al. | |
| 6,644,314 | B1 | 11/2003 | Elsberg | |
| 6,923,182 | B2 | 8/2005 | Angadjivand | |
| 7,086,400 | B2 | 8/2006 | Shigematsu et al. | |
| 7,121,279 | B2 | 10/2006 | Dennis | |
| 7,131,442 | B1 | 11/2006 | Kronzer | |
| 2003/0154984 | A1* | 8/2003 | Fernandes | 128/205.27 |
| 2003/0205231 | A1 | 11/2003 | Shigematsu et al. | |
| 2006/0130841 | A1 | 6/2006 | Spence et al. | |
| 2006/0219246 | A1 | 10/2006 | Dennis | |
| 2007/0044803 | A1 | 3/2007 | Xue et al. | |
| 2007/0068529 | A1 | 3/2007 | Kalatoor et al. | |
| 2009/0020126 | A1* | 1/2009 | Lau | 128/207.11 |

FOREIGN PATENT DOCUMENTS

| | | | |
|---|---|---|---|
| GB | 2059782 | A | 4/1981 |
| GB | 2103491 | A | 2/1983 |
| JP | 2003-093528 | | 4/2003 |
| JP | 3117121 | | 1/2006 |
| KR | 20-2000-0010554 | | 6/2000 |
| KR | 10-2006-0083536 | | 7/2006 |

OTHER PUBLICATIONS

Moldex 2200N Series N95 Particulate Respirators product literature (Sep. 2005).

European Application No. 08837528 Supplemental Search Report dated Jun. 23, 2011.

* cited by examiner

FILTERING FACE-PIECE RESPIRATOR HAVING NOSE CLIP MOLDED INTO THE MASK BODY

CROSS-REFERENCE TO RELATED APPLICATION

This application claims the benefit of U.S. Provisional Patent Application No. 60/978,431 filed Oct. 9, 2007.

The present invention pertains to a filtering face-piece respirator that has its nose clip molded into the mask body.

BACKGROUND

Respirators are commonly worn over the breathing passages of a person for at least one of two common purposes: (1) to prevent impurities or contaminants from entering the wearer's breathing track; and (2) to protect other persons or things from being exposed to pathogens and other contaminants exhaled by the wearer. In the first situation, the respirator is worn in an environment where the air contains particles that are harmful to the wearer, for example, in an auto body shop. In the second situation, the respirator is worn in an environment where there is risk of contamination to other persons or things, for example, in an operating room or clean room.

A variety of respirators have been designed to meet either (or both) of these purposes. Some of these respirators have been categorized as being "filtering face-pieces" because the mask body itself functions as the filtering mechanism. Unlike respirators that use rubber or elastomeric mask bodies in conjunction with attachable filter cartridges (see, e.g., U.S. Pat. RE39,493 to Yuschak et al.) or insert-molded filter elements (see, e.g., U.S. Pat. No. 4,790,306 to Braun), filtering face-piece respirators have the filter media cover much of the whole mask body so that there is no need for installing or replacing a filter cartridge. Conventional filtering face piece respirators have regularly comprised non-woven webs of thermally-bonding fibers or open-work plastic meshes to furnish the mask body with its cup-shaped configuration. As such, filtering face-piece respirators are relatively light in weight and easy to use. Examples of patents that disclose filtering face-piece respirators include U.S. Pat. No. 7,131,442 to Kronzer et al, U.S. Pat. Nos. 6,923,182 and 6,041,782 to Angadjivand et al. U.S. Pat. Nos. 6,568,392 and 6,484,722 to Bostock et al., U.S. Pat. No. 6,394,090 to Chen, U.S. Pat. No. 4,873,972 to Magidson et al., U.S. Pat. No. 4,850,347 to Skov, U.S. Pat. No. 4,807,619 to Dyrud et al., U.S. Pat. No. 4,536,440 to Berg, and Des. 285,374 to Huber et al.

Often a nose clip is provided on the mask body of the filtering face-piece to achieve a snug fit over the wearer's nose. The nose clip is commonly in the form of malleable, linear, strip of aluminum—see, for example, U.S. Pat. Nos. 5,307,796, 4,600,002, and 3,603,315 and U.K. Patent Application GB 2,103,491 A. A more recent nose clip product uses an M-shaped band of aluminum to improve fit over the wearer's nose—see U.S. Pat. No. 5,558,089 and Des. 412,573 to Castiglione. Other filtering face-piece respirators have used manually-pliable polymeric nose clips or spring-loaded nose clips—see U.S. Patent Applications 2007-0068529A1 to Kalatoor et al. and 2007-0044803A1 to Xue et al. Metal nose clips are regularly secured to the mask body through use of an adhesive, although welding techniques also have been suggested for polymeric nose clips.

SUMMARY OF THE INVENTION

The present invention provides a new technique for securing a nose clip to a filtering face-piece respirator. Rather than use an adhesive or a welding step to bond the nose clip to the mask body, the present invention uses a plastic support structure that is molded at least partially about the nose clip and thus eliminates the need for an additional material—namely, an adhesive—and eliminates the need for an additional manufacturing step—namely, bonding. In the present invention, the nose clip becomes secured to the mask body at the same time as formation of the support structure. There is accordingly no need to separately adhere or weld the nose clip to the mask body.

The present invention provides a new filtering face-piece respirator that comprises (a) a harness; and (b) a mask body that comprises: (i) a filtering structure; (ii) a plastic support structure; and (iii) a nose clip that is secured to the plastic support structure by having the plastic support structure molded thereabout.

The present invention also provides a new method of making a filtering face-piece respirator mask body, which method comprises (a) providing a nose clip; (b) insert molding a plastic support structure about at least part of the nose clip; and (c) joining a filtering structure to the plastic support structure.

Unlike conventional filtering face-piece respirators, the present invention bonds the nose clip to the mask body by molding it into the support structure. To make a mask body according to the invention, the support structure is injection molded about at least part of the nose clip. This molding step can be carried out when the support structure is being produced. Because conventional filtering face-piece mask respirators regularly used shaping layers that comprised molded nonwoven webs of thermally-bonded fibers or open-work filamentary meshes to provide structural integrity to the mask body, the ability to injection mold the nose clip into the mask body was lacking. The present invention eliminates the need for these additional parts and manufacturing steps when it molds the mask body support structure about the nose clip.

GLOSSARY

The terms set forth below will have the meanings as defined:

"adequate securement" means not coming loose or becoming separated therefrom under normal use;

"bisect(s)" means to divide into two generally equal parts;

"centrally spaced" means separated significantly from one another along a line or plane that bisects the mask body vertically;

"comprises (or comprising)" means its definition as is standard in patent terminology, being an open-ended term that is generally synonymous with "includes", "having", or "containing". Although "comprises", "includes", "having", and "containing" and variations thereof are commonly-used, open-ended terms, this invention also may be suitably described using narrower terms such as "consists essentially of", which is semi open-ended term in that it excludes only those things or elements that would have a deleterious effect on the performance of the inventive respirator in serving its intended function;

"clean air" means a volume of atmospheric ambient air that has been filtered to remove contaminants;

"contaminants" means particles (including dusts, mists, and fumes) and/or other substances that generally may not be considered to be particles (e.g., organic vapors, et cetera) but which may be suspended in air, including air in an exhale flow stream;

"crosswise dimension" is the dimension that extends laterally across the respirator from side-to-side when the respirator is viewed from the front;

"elastic" means having the ability to return to its initial form or state after being stretched to 100% or more of its initial length;

"exhalation valve" means a valve that opens to allow a fluid to exit a filtering face mask's interior gas space;

"exterior gas space" means the ambient atmospheric gas space into which exhaled gas enters after passing through and beyond the mask body and/or exhalation valve;

"filtering face-piece" means that the mask body itself is designed to filter air that passes through it; there are no separately identifiable filter cartridges or insert-molded filter elements attached to or molded into the mask body to achieve this purpose;

"filter" or "filtration layer" means one or more layers of air-permeable material, which layer(s) is adapted for the primary purpose of removing contaminants (such as particles) from an air stream that passes through it;

"filtering structure" means a construction that is designed primarily for filtering air;

"first side" means an area of the mask body that is laterally distanced from a plane that bisects the mask vertically and that would reside in the region of a wearer's cheek and/or jaw when the respirator is being donned;

"harness" means a structure or combination of parts that assists in supporting the mask body on a wearer's face;

"insert molding" means molding the plastic about at least part of a solid item that has already been placed into the mold;

"integral" means being manufactured together at the same time; that is, being made together as one part and not two separately manufactured parts that are subsequently joined together;

"interior gas space" means the space between a mask body and a person's face;

"line of demarcation" means a fold, seam, weld line, bond line, stitch line, hinge line, and/or any combination thereof;

"mask body" means an air-permeable structure that is designed to fit over the nose and mouth of a person and that helps define an interior gas space separated from an exterior gas space;

"member", in relation to the support structure, means an individually and readily identifiable solid part that is sized to contribute significantly to the overall construction and configuration of the support structure;

"molded" or "molding" means forming into a desired solid shape condition from a previous liquid condition;

"molded about" and "molded thereabout" means placed in contact with a solid item sufficiently through molding to enable adequate securement thereto;

"nose clip" means a mechanical device (other than a nose foam), which device is adapted for use on a mask body to improve the seal at least around a wearer's nose;

"perimeter" means the outer edge of the mask body, which outer edge would be disposed generally proximate to a wearer's face when the respirator is being donned by a person;

"polymeric" and "plastic" each mean a material that mainly includes one or more polymers and that may contain other ingredients as well;

"plurality" means two or more;

"respirator" means an air filtration device that is worn by a person to provide the wearer with clean air to breathe;

"second side" means an area of the mask body that is distanced from a plane line that bisects the mask vertically (the second side being opposite the first side) and that would reside in the region of a wearer's cheek and/or jaw when the respirator is being donned;

"support structure" means a construction that is designed to have sufficient structural integrity to retain its desired shape and to help retain the intended shape of the filtering structure that is supported by it;

"spaced" means physically separated or having measurable distance therebetween; and "transversely extending" means extending generally in the crosswise dimension.

DETAILED DESCRIPTION OF PREFERRED EMBODIMENTS

In practicing the present invention, a filtering face-piece respirator is provided that has a nose clip attached to the support structure of the mask body through molding. Rather than use an adhesive or a welding step to adequately secure the nose clip to the mask body, the present invention can secure the nose clip to the support structure at the time the support structure is being made. The new respirator and method are particularly beneficial in that they provide an economic improvement to mask body manufacture. The use of a molded-in-place nose clip eliminates the need for separately securing the nose clip to the mask body.

Figure 1:
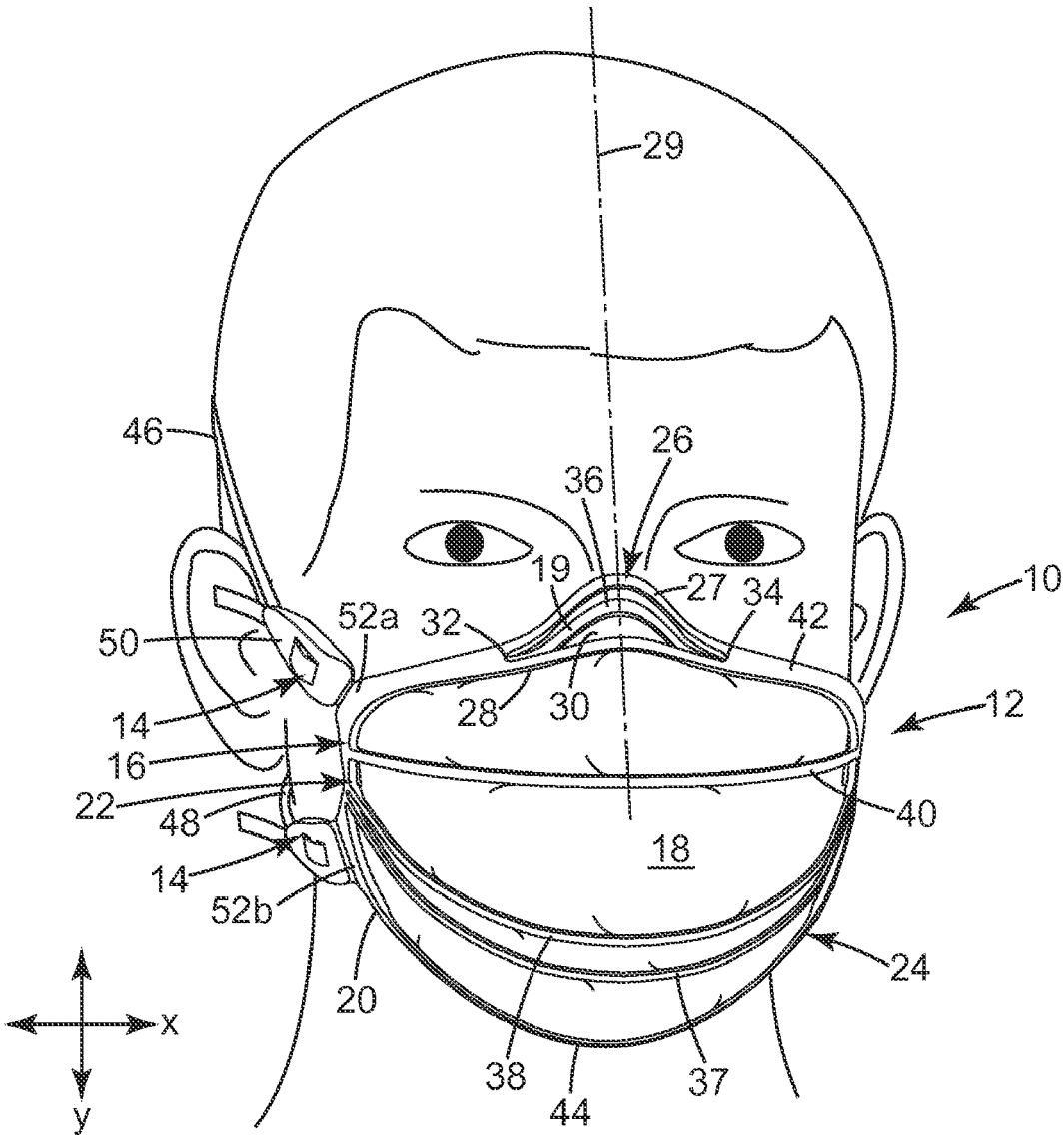
FIG. 1 shows a front perspective view of a filtering face-piece respirator 10, in accordance with the present invention, being worn on a person's face.

FIG. 1 shows an example of a filtering face-piece respirator 10 that may be used in accordance with the present invention to provide clean air for the wearer to breathe. As illustrated, the filtering face-piece respirator 10 includes a mask body 12 and a harness 14. The mask body 12 has a plastic support structure 16 that provides structural integrity to the mask body and that provides support for a filtering structure 18. The filtering structure 18 removes contaminants from the ambient air when the wearer inhales. A nose clip 19 extends across the bridge of the wearer's nose in the cross-wise dimension and is secured to the plastic support structure 16 by having the support structure molded about the nose clip 19. The support structure 16 also includes a perimeter 20, a first side 22, and an opposing second side 24. The perimeter 20 of the support structure 16 may, but not necessarily, contact the wearer's face when the respirator 10 is being donned. The perimeter 20 may comprise a member, or combination of members, that extend 360° continuously about, and adjacent to, the periphery of the mask body 12. The nose portion 26 of the mask body 12 has first and second converging members 27 and 28, respectively that define an opening 30. The nose clip 19 visibly extends across the opening and is molded into the support structure 16 at first and second ends 32 and 34. The central portion 36 of the nose clip 19 is visibly exposed in the opening so that the wearer can see the clip to know of its presence and so that it can be properly deformed into a desired shape or configuration so that the mask 12 snugly fits the wearer over the bridge of the nose and against the face beneath the eyes. Typically, the wearer's face will contact only the inner surface of the periphery of the filtering structure 18 or an additional face seal material. Thus, the peripheral edge of the filtering structure 18 may project radially beyond the perimeter 20 of the support structure 16. The support structure 16 also includes one or more centrally-spaced, transversely-extending members 37, 38, and 40. The transversely-extending members 37, 38, and 40 extend from a first side 22 of the mask body 12 to a second side 24. The invention, however, does contemplate embodiments where the transversely-extending members do not need to extend fully across the mask body 12. One or more members also could extend in the longitudinal dimension between the top perimeter member 42 and the bottom perimeter member 44. The whole plastic support structure may be produced as a single integral part. When viewing the respirator as projected onto a plane from the front, the transverse direction is the direction that extends across the respirator in the general "x" direction, and the longitudinal direction is the dimension that extends between the bottom and top of the respirator 10 in the general "y" direction. One or more of the transversely-extending members and/or peripheral members may expand or contract longitudinally to better accommodate wearer jaw movement and various sized faces—see U.S. Patent Application Ser. No. 60/974,025 entitled Filtering Face-Piece Respirator that Has Expandable Mask Body, filed on Sep. 20, 2007. The transversely-extending members, longitudinally-extending members, and peripheral members may be sized to have cross-sectional areas that are about 2 to 12 $mm^2$ in size, more typically about 4 to 8 $mm^2$ in size. The respirator 10 can be supported on the face of the wearer by the harness 14 that includes first and second straps 46 and 48. These straps 46, 48 may be adjusted in length by one or more buckles 50. The buckles 50 are secured to the mask body 12 at the first and second sides 22, 24 at harness-securement flange members 52*a*, 52*b*. Although the drawings illustrate a respirator 10 that has four buckles secured to the mask body 12, it may be possible to use a lesser number of buckles. For example, it may be possible to use only one strap; whereby, the strap is mounted directly to the mask body on one side and is joined to the mask body through a single buckle located on the other side. In such an instance, the strap length would only be adjusted on one side of the mask body rather than on both sides. Alternatively, a single strap construction could be used, whereby a single buckle is located on first and second sides of the mask body. In another embodiment, two buckles 50 may be used on the mask body with two straps; whereby, each strap is secured directly to the respirator on one side and is secured to the respirator on another side through a buckle 50. Or as shown in the drawings, four buckles may be used to provide four strap adjustment points between two straps.

Figure 2:
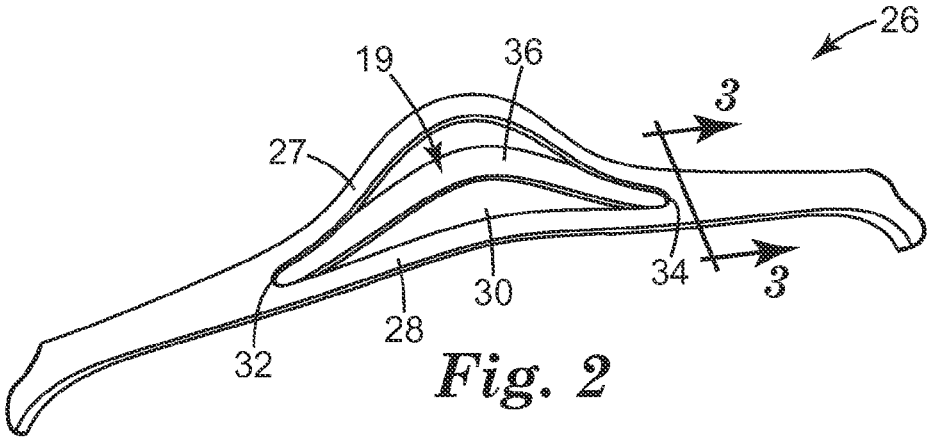
FIG. 2 is an enlarged perspective view of the nose portion 26 of the mask body support structure 16.

FIG. 2 shows the nose portion 26 of the support structure 16 (FIG. 1) in an enlarged format to better illustrate how the nose clip 19 can be secured to the support structure. The nose clip 19 extends across an opening 30 that is defined by first and second transversely-extending members 27 and 28. Members 27 and 28 constitute upper and lower nose bridge members that are separated from each other along a plane 29 (FIG. 1) that bisects the nose portion 26. Centrally-spaced members 27 and 28 converge towards one another at first and second ends 32 and 34 of the nose clip 19. At a central portion 36 of the nose clip 19, the nose clip 19 is not embedded in the support structure 16. The nose clip can be deformed into its desired shape to provide a proper fit over the bridge of a wearer's nose. The nose clip 19 also may be deformed at the first and second ends 32 and 34 so that the mask body 12 (FIG. 1) is properly pressed up against the wearer's face beneath each of the wearer's eyes. As shown, the nose clip 19 is molded into the support structure 16 (FIG. 1) at each of the first and second ends 32 and 34 of the nose clip 19. The cross members 27 and 28 do not necessarily need to be used on the nose portion 26 but may be provided to reduce pressure points and to help achieve a snug fit.

Figure 3:
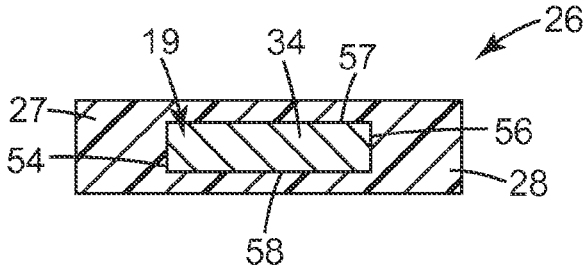
FIG. 3 is a cross-sectional view of the nose portion 26 taken along lines 3-3 of FIG. 2.

FIG. 3 particularly shows how the nose clip 19 may be molded into the nose portion 26 of the support structure 16 at the second end 34. As illustrated, the first member 27 is molded about a first edge 54 of the nose clip 19, and the second member 28 is molded about a second edge 56 of the nose clip 19. The first and second members 27 and 28 converge towards each other to merge and encompass the nose clip 19 on its first and second major surfaces 57 and 58. Thus, at each end 32, 34 of the nose clip 19, the nose clip 19 may be fully surrounded circumferentially by plastic from the support structure 16 (FIG. 1) such that the support structure is a sleeve that has been molded tubularly about the nose clip 19. Between the first and second ends 32 and 34, however, the nose clip 19 may be exposed so that it is visible to the wearer. The regions where the nose clip 19 is encapsulated tubularly by the plastic support structure material nonetheless also may be able to be adapted in shape. Thus, the plastic material that comprises the support structure preferably is not so rigid that it cannot be deformed be mere finger pressure from the wearer. Because the polymeric material that is used in the support structure can be so manually deformed, and because the nose clip is made from a manually-malleable, plastically deformable, material, the nose clip 19 is able to maintain its shape, and the shape of the nose portion 26 of the mask body 12 (FIG. 1), after it has been deformed into its desired shape by the respirator wearer. The plastically deformable nature of the nose clip material allows it to withstand any forces from the resilient polymeric support structure material so that the nose portion can largely retain its adapted shape. When adapting the shape of the nose portion of the mask body, the nose clip will plastically deform, whereas the nose portion of the support structure will not so plastically deform. The minimum force needed to plastically deform the nose clip into its desired shape is greater than "spring back" forces exerted by the support structure members in the nose portion. If desired, the whole length of the nose clip could be embedded in the polymeric support structure material.

The nose clip 19 can be molded into the support structure as shown in FIGS. 2 and 3 through an insert molding process. In this process, the insert, which in this instance may be a metal nose clip, is placed into the mold in a desired location before the plastic is injected or otherwise introduced into the mold cavity. The bonding between the metal nose clip and the plastic may be molecular or mechanical or a combination thereof. Because the nose clip is typically made from a non-resilient metal, which is dissimilar to the contacting resin, the bonding between the nose clip and its support structure may be more mechanical in nature. The mechanical bonding can occur by, for example, shrinking the resin around the insert as the resin cools or by providing the nose clip with irregularities on its surface. Although shrinkage will typically occur, it may be possible to rely on both on the shrinkage of the resin and any irregularities in the nose clip surfaces (54, 56, 57, and/or 58). The nose clip can be provided with a roughened or coarse pattern to improve mechanical bonding. To adequately secure the nose clip 19 to the nose portion 26 of the support structure 16, the molding may be performed using standard molding, casting, or other suitable equipment. The nose clip is loaded in and properly retained into the desired location or insert position within the mold cavity. Rotary or shuttle-type equipment may be used for this purpose to enable the equipment and/or operators to load and unload nose clip inserts into the desired mold location. Other machines, for example, mold clamping, also may be used. For optimum productivity, the time taken to load and unload the inserts desirably will not significantly exceed the molding-cycle time. Because the plastic may be injected into the cavity around the insert, it is important that the insert be able to withstand any pressures from the polymeric liquid and that its location be maintained during the molding process. The nose clip preferably should be kept clean to prevent any failure in the mechanical bond and/or the molecular bond. The nose clip may, for example, be preheated to minimize any stresses that could be caused by differential thermal expansion or contraction. If the nose clips are manually loaded, it can be important for the operator to maintain consistent cycle time. The nose clips typically are bent into their desired inverted u-shaped configuration to match the general curvature of the members 27, 28 in the nose portion 26 of the support structure 16 (FIGS. 1 and 2). This bending may occur before or during the molding process. That is, the nose clip may be bent before being inserted into the mold, or it may be bent when the mold is closed. Thus, a variety of the above considerations may be needed to be taken into account to insure proper securement of the nose clip to the polymer and satisfactory performance of the finished article.

Figure 4:
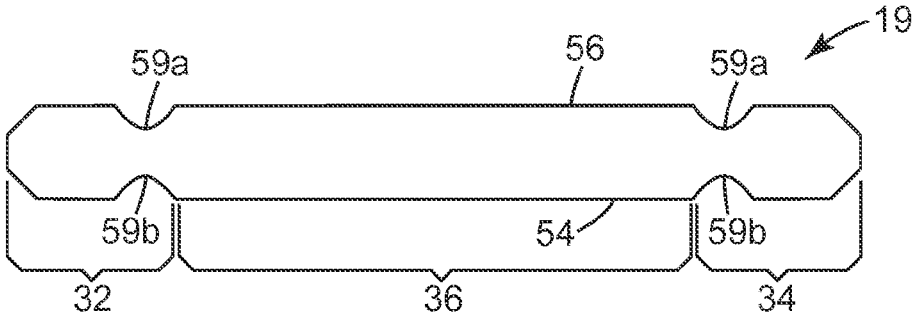
FIG. 4 is a plan view of a nose clip 19 that may be used in connection with the present invention.

FIG. 4 shows an example of a nose clip shape that can be used in connection with the present invention. The nose clip 19 can have first and second discontinuities 59*a* and 59*b* at the first and second ends 32 and 34 of the nose clip 19. As used in this document, the word "end" does not mean the immediate end or edge of the part but comprises a general region towards the very end like, for example, in referring to the "front end of a car" or the "north end of town". The discontinuities in the first and second edges 54 and 56 of the nose clip 19 may be notches, that is, discontinuities that extend inwardly from the edges 54 and 56. Alternatively, the discontinuities could be protrusions or bumps that extend outwardly from the edges 54, 56. Combinations of notches and protuberances also could be used in conjunction with, for example, discontinuities in the first and second major surfaces 57 and 58 (FIG. 3). The first and second major surfaces 57 and 58 also could be embossed. All of these various discontinuities constitute means for improving a mechanical bond to the nose clip.

As indicated above, the nose clip can be joined to the support structure by insert molding. Known plastics such as olefins including, polyethylene, polypropylene, polybutylene, and polymethyl(pentene); plastomers; thermoplastics; thermoplastic elastomers; and blends thereof may be used to make the support structure. Additives such as pigments, UV stabilizers, anti-block agents, nucleating agents, fungicides, and bactericides also may be added to the composition that forms the buckle and/or support structure. The resulting plastic typically exhibits a Stiffness in Flexure of about 75 to 300 Mega Pascals (MPa), more typically about 100 to 250 MPa, and still typically about 175 to 225 MPa. The plastic used for the support structure can be selected to exhibit resilience, shape memory, and resistance to flexural fatigue so that the support structure, nose portion, and buckle attachment portions can be deformed to accommodate proper fitting and strap tension forces. The support structure members may be rectangular, circular, triangular, elliptical, trapezoidal, etc., when viewed in cross-section. The support structure is a part or assembly that is not integral to (or made together with) the filtering structure and comprises members that are sized to be larger than the fibers used in the filtering structure.

Figure 5:
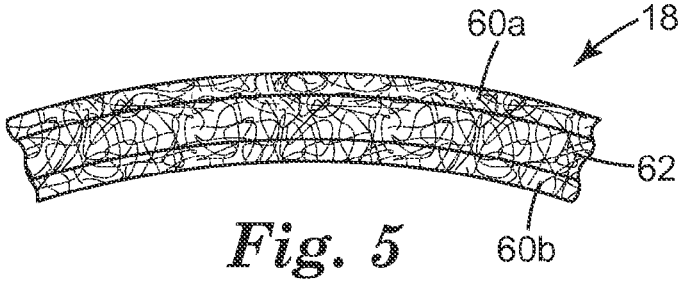
FIG. 5 is a cross-sectional view of a filtering structure 18 that may be used in a mask body 12 of the present invention.

FIG. 5 shows a cross-section of a filtering structure 18 that may be used in connection with the present invention. The filtering structure 18 may include one or more cover webs 60*a* and 60*b* and a filtration layer 62. The cover webs 60*a* and 60*b* may be located on opposing sides of the filtration layer 62 to capture any fibers that could come loose therefrom. Typically, the cover webs 60*a* and 60*b* are made from a selection of fibers that provide a comfortable feel, particularly on the side of the filtering structure 18 that makes contact with the wearer's face. The construction of various filter layers and cover webs that may be used in conjunction with the support structure of the present invention are described below in more detail. To improve fit and wearer comfort, an elastomeric face seal can be secured to the perimeter of the filtering structure 18. Such a face seal may extend radially inward to contact the wearer's face when the respirator is being donned. Examples of face seals are described in U.S. Pat. No. 6,568,392 to Bostock et al., U.S. Pat. No. 5,617,849 to Springett et al., and U.S. Pat. No. 4,600,002 to Maryyanek et al., and in Canadian Patent 1,296,487 to Yard.

The filtering structure may take on a variety of different shapes and configurations. The filtering structure typically is adapted so that it properly fits against or within the support structure. Generally the shape and configuration of the filtering structure corresponds to the general shape of the support structure. The filtering structure may be disposed radially inward from the support structure, it may be disposed radially outward from the support structure, or it may be disposed between various members that comprise the support structure. Although a filtering structure has been illustrated with multiple layers that include a filtration layer and two cover webs, the filtering structure may simply comprise a filtration layer or a combination of filtration layers. For example, a pre-filter may be disposed upstream to a more refined and selective downstream filtration layer. Additionally, sorptive materials such as activated carbon may be disposed between the fibers and/or various layers that comprise the filtering structure. Further, separate particulate filtration layers may be used in conjunction with sorptive layers to provide filtration for both particulates and vapors. The filtering structure may include one or more stiffening layers that allow such a cup-shaped configuration to be maintained. Alternatively, the filtering structure could have one or more horizontal and/or vertical lines of demarcation that contribute to its structural integrity to help maintain the cup-shaped configuration.

The filtering structure that is used in a mask body of the invention can be of a particle capture or gas and vapor type filter. The filtering structure also may be a barrier layer that prevents the transfer of liquid from one side of the filter layer to another to prevent, for instance, liquid aerosols or liquid splashes (e.g. blood) from penetrating the filter layer. Multiple layers of similar or dissimilar filter media may be used to construct the filtering structure of the invention as the application requires. Filters that may be beneficially employed in a layered mask body of the invention are generally low in pressure drop (for example, less than about 195 to 295 Pascals at a face velocity of 13.8 centimeters per second) to minimize the breathing work of the mask wearer. Filtration layers additionally are flexible and have sufficient shear strength so that they generally retain their structure under the expected use conditions. Examples of particle capture filters include one or more webs of fine inorganic fibers (such as fiberglass) or polymeric synthetic fibers. Synthetic fiber webs may include electret-charged polymeric microfibers that are produced from processes such as meltblowing. Polyolefin microfibers formed from polypropylene that has been electrically charged provide particular utility for particulate capture applications. An alternate filter layer may comprise a sorbent component for removing hazardous or odorous gases from the breathing air. Sorbents may include powders or granules that are bound in a filter layer by adhesives, binders, or fibrous structures—see U.S. Pat. No. 6,334,671 to Springett et al. and U.S. Pat. No. 3,971,373 to Braun. A sorbent layer can be formed by coating a substrate, such as fibrous or reticulated foam, to form a thin coherent layer. Sorbent materials may include activated carbons that are chemically treated or not, porous alumna-silica catalyst substrates, and alumna particles. An example of a sorptive filtration structure that may be conformed into various configurations is described in U.S. Pat. No. 6,391,429 to Senkus et al.

The filtration layer is typically chosen to achieve a desired filtering effect. The filtration layer generally will remove a high percentage of particles and/or or other contaminants from the gaseous stream that passes through it. For fibrous filter layers, the fibers selected depend upon the kind of substance to be filtered and, typically, are chosen so that they do not become bonded together during the molding operation. As indicated, the filtration layer may come in a variety of shapes and forms and typically has a thickness of about 0.2 millimeters (mm) to 1 centimeter (cm), more typically about 0.3 mm to 0.5 cm, and it could be a generally planar web or it could be corrugated to provide an expanded surface area—see, for example, U.S. Pat. Nos. 5,804,295 and 5,656,368 to Braun et al. The filtration layer also may include multiple filtration layers joined together by an adhesive or any other means. Essentially any suitable material that is known (or later developed) for forming a filtering layer may be used for the filtering material. Webs of melt-blown fibers, such as those taught in Wente, Van A., *Superfine Thermoplastic Fibers,* 48 Indus. Engn. Chem., 1342 et seq. (1956), especially when in a persistent electrically charged (electret) form are especially useful (see, for example, U.S. Pat. No. 4,215,682 to Kubik et al.). These melt-blown fibers may be microfibers that have an effective fiber diameter less than about 20 micrometers (μm) (referred to as BMF for "blown microfiber"), typically about 1 to 12 μm. Effective fiber diameter may be determined according to Davies, C. N., *The Separation Of Airborne Dust Particles*, Institution Of Mechanical Engineers, London, Proceedings 1B, 1952. Particularly preferred are BMF webs that contain fibers formed from polypropylene, poly(4-methyl-1-pentene), and combinations thereof. Electrically charged fibrillated-film fibers as taught in van Turnhout, U.S. Pat. Re. 31,285, also may be suitable, as well as rosin-wool fibrous webs and webs of glass fibers or solution-blown, or electrostatically sprayed fibers, especially in microfilm form. Electric charge can be imparted to the fibers by contacting the fibers with water as disclosed in U.S. Pat. No. 6,824,718 to Eitzman et al., U.S. Pat. No. 6,783,574 to Angadjivand et al., U.S. Pat. No. 6,743,464 to Insley et al., U.S. Pat. Nos. 6,454,986 and 6,406,657 to Eitzman et al., and U.S. Pat. Nos. 6,375,886 and 5,496,507 to Angadjivand et al. Electric charge also may be imparted to the fibers by corona charging as disclosed in U.S. Pat. No. 4,588,537 to Klasse et al. or by tribocharging as disclosed in U.S. Pat. No. 4,798,850 to Brown. Also, additives can be included in the fibers to enhance the filtration performance of webs produced through the hydro-charging process (see U.S. Pat. No. 5,908,598 to Rousseau et al.). Fluorine atoms, in particular, can be disposed at the surface of the fibers in the filter layer to improve filtration performance in an oily mist environment—see U.S. Pat. Nos. 6,398,847 B1, 6,397,458 B1, and 6,409,806 B1 to Jones et al. Typical basis weights for electret BMF filtration layers are about 10 to 100 grams per square meter. When electrically charged according to techniques described in, for example, the '507 Angadjivand et al. patent, and when including fluorine atoms as mentioned in the Jones et al. patents, the basis weight may be about 20 to 40 g/m$^2$ and about 10 to 30 g/m$^2$, respectively.

An inner cover web can be used to provide a smooth surface for contacting the wearer's face, and an outer cover web can be used to entrap loose fibers in the mask body or for aesthetic reasons. The cover web typically does not provide any substantial filtering benefits to the filtering structure, although it can act as a pre-filter when disposed on the exterior (or upstream to) the filtration layer. To obtain a suitable degree of comfort, an inner cover web preferably has a comparatively low basis weight and is formed from comparatively fine fibers. More particularly, the cover web may be fashioned to have a basis weight of about 5 to 50 g/m$^2$ (typically 10 to 30 g/m$^2$), and the fibers may be less than 3.5 denier (typically less than 2 denier, and more typically less than 1 denier but greater than 0.1). Fibers used in the cover web often have an average fiber diameter of about 5 to 24 micrometers, typically of about 7 to 18 micrometers, and more typically of about 8 to 12 micrometers. The cover web material may have a degree of elasticity (typically, but not necessarily, 100 to 200% at break) and may be plastically deformable.

Suitable materials for the cover web may be blown microfiber (BMF) materials, particularly polyolefin BMF materials, for example polypropylene BMF materials (including polypropylene blends and also blends of polypropylene and polyethylene). A suitable process for producing BMF materials for a cover web is described in U.S. Pat. No. 4,013,816 to Sabee et al. The web may be formed by collecting the fibers on a smooth surface, typically a smooth-surfaced drum or a rotating collector—see U.S. Pat. No. 6,492,286 to Berrigan et al. Spun-bond fibers also may be used.

A typical cover web may be made from polypropylene or a polypropylene/polyolefin blend that contains 50 weight percent or more polypropylene. These materials have been found to offer high degrees of softness and comfort to the wearer and also, when the filter material is a polypropylene BMF material, to remain secured to the filter material without requiring an adhesive between the layers. Polyolefin materials that are suitable for use in a cover web may include, for example, a single polypropylene, blends of two polypropylenes, and blends of polypropylene and polyethylene, blends of polypropylene and poly(4-methyl-1-pentene), and/or blends of polypropylene and polybutylene. One example of a fiber for the cover web is a polypropylene BMF made from the polypropylene resin "Escorene 3505G" from Exxon Corporation, providing a basis weight of about 25 g/m$^2$ and having a fiber denier in the range 0.2 to 3.1 (with an average, measured over 100 fibers of about 0.8). Another suitable fiber is a polypropylene/polyethylene BMF (produced from a mixture comprising 85 percent of the resin "Escorene 3505G" and 15 percent of the ethylene/alpha-olefin copolymer "Exact 4023" also from Exxon Corporation) providing a basis weight of about 25 g/m$^2$ and having an average fiber denier of about 0.8. Suitable spunbond materials are available, under the trade designations "Corosoft Plus 20", "Corosoft Classic 20" and "Corovin PP-S-14", from Corovin GmbH of Peine, Germany, and a carded polypropylene/viscose material available, under the trade designation "370/15", from J. W. Suominen OY of Nakila, Finland.

Cover webs that are used in the invention preferably have very few fibers protruding from the web surface after processing and therefore have a smooth outer surface. Examples of cover webs that may be used in the present invention are disclosed, for example, in U.S. Pat. No. 6,041,782 to Angadjivand, U.S. Pat. No. 6,123,077 to Bostock et al., and WO 96/28216A to Bostock et al.

The straps that are used in the harness may be made from a variety of materials, such as thermoset rubbers, thermoplastic elastomers, braided or knitted yarn/rubber combinations, inelastic braided components, and the like. The straps may be made from an elastic material such as an elastic braided material. The strap preferably can be expanded to greater than twice its total length and be returned to its relaxed state. The strap also may be increased to three or four times its relaxed state length and can be returned to its original condition without any damage thereto when the tensile forces are removed. The elastic limit thus is preferably not less than two, three, or four times the length of the strap when in its relaxed state. Typically, the straps are about 25 to 60 cm long, 5 to 10 mm wide, and about 0.9 to 1.5 mm thick. The straps may extend from the first buckle to a second buckle on an opposing side of the mask body as a continuous strap or the strap may have a plurality of parts, which can be joined together by further fasteners or buckles. For example, the strap may have first and second parts that are joined together by a fastener that can be quickly uncoupled by the wearer when removing the mask body from the face. An example of a strap that may be used in connection with the present invention is shown in U.S. Pat. No. 6,332,465 to Xue et al. Examples of fastening or clasping mechanism that may be used to joint one or more parts of the strap together is shown, for example, in the following U.S. Pat. No. 6,062,221 to Brostrom et al., U.S. Pat. No. 5,237,986 to Seppala, and EP1,495,785A1 to Chien.

An exhalation valve may be attached to the mask body to facilitate purging exhaled air from the interior gas space. The use of an exhalation valve may improve wearer comfort by rapidly removing the warm moist exhaled air from the mask interior. See, for example, U.S. Pat. Nos. 7,188,622, 7,028,689, and 7,013,895 to Martin et al.; U.S. Pat. Nos. 7,117,868, 6,854,463, 6,843,248, and 5,325,892 to Japuntich et al.; U.S. Pat. No. 6,883,518 to Mittelstadt et al.; and RE37,974 to Bowers. Essentially any exhalation valve that provides a suitable pressure drop and that can be properly secured to the mask body may be used in connection with the present invention to rapidly deliver exhaled air from the interior gas space to the exterior gas space.

EXAMPLE

Stiffness in Flexure Test

The stiffness in flexure of material used to make the support structure was measured according to ASTM D 5342-97 section 12.1 to 12.7. In so doing, six test specimens were cut from a blank film into rectangular pieces that were about 25.4 mm wide by about 70 mm long. The specimens were prepared as described below. Taber V-5 Stiffener tester Model 150-E (from Taber Corporation, 455 Bryant Street, North Tonawanda, N.Y., 14120) was used in 10-100 Taber stiffness unit configurations to measure the test specimens. The Taber Stiffness readings were recorded from the equipment display at the end of the test, and the Stiffness in Flexure was calculated using the following equation:

$$\text{Stiffness in Flexure (Pa)} = 7{,}492\frac{N\,\text{cm}^4}{M^2}\left(\frac{\text{Taber Stiffness}}{\text{Width} * thickness^3}\right)$$

Taber Stiffness=recorded material resistance to bending measured according to ASTM D5342-97 section 12.1 to 12.7.

Width=width of test film specimen in cm, which was 2.54 cm.

Thickness=average thickness of test specimen in cm measured using standard digital caliper at five equally-spaced locations along the length, of the material.

The stiffness in flexure from the six samples were averaged to get the Stiffness in Flexure of the material.

Test specimens for the Stiffness in Flexure Test were prepared from the same compounded polymer ingredients that were blended together to make the respirator support structure. Forty (40) grams of the compound were used to make a circular film that was 114 mm in radius and 0.51 to 0.64 mm thick. The first 40 grams of the compounded material was poured into a twin screw roller blade Type Six BRABENDER mixer (from C.W. Brabender instruments Inc., 50 East Wesley Street, P.O. Box 2127, South Hackensack, N.J., 07606). The mixer was operating at 75 revolutions per minute (RPM) and at a temperature of 185° C. After blending the molten compound for about 10 minutes, the mixture was pressed under 44.5 kilonewtons (KN) of force to make the 0.51 to 0.64 mm thick flat circular film that was 114 mm in diameter. The compression was conducted using a hot platen set at 149° C. The hot platen was a Genesis 30 ton Compression molding press from WABASH Equipments 1569 Morris Street, P.O. Box 298, Wabash, Ind. 46992. Before testing for Stiffness in Flexure, the films were cut to the required test specimen sizes of 25.4 mm wide by 70 mm long.

Respirator Support Structure Manufacture

Samples of the respirator support structure were made using a standard injection molding process. Single cavity male and female molds, matching the geometry of the support structure shown in FIG. 1 were manufactured at a tool manufacturer. At a relaxed state, or while the support structure was still on the mold, the support structure measured about 115 mm, top to bottom, and about 120 mm from side to side. The measurement was made along a direct line between the highest and lowest points on the perimeter and the outer edges of the side perimeter members, respectively while the respirator was in an unstressed state. The targeted thickness of the members that comprised the support structure was 2.5 millimeters. The transversely-extending members were given a trapezoidal cross-section to allow the support structure to be more easily removed from the mold. The cross-sectional area of the transversely-extending members ranged from about 2 to 5 $mm^2$. The flanges and buckles had the shape and configuration shown in U.S. Patent Application Ser. No. 60/994,644 entitled Buckle Having A Flexural Strap Attachment Member And Respirator Using Such Buckle, filed on Sep. 20, 2007. A polypropylene/thermoplastic elastomer mixture was fed into the extruder with a white pigment. Propylene 5724 from Total was used at 78 wt %; Septon™ 2063 from Kuraray at 20 wt %; and 2 wt % $TiO_2$ pigment. The support structure exhibited a Stiffness in Flexure of about 240 MPa.

Respirator Filtering Structure Manufacture

Respirator filtering structures were formed from two layers of nonwoven fibrous electret filter material that was 254 mm wide, laminated between one 50 grams per square meter (gsm) outer layer of white nonwoven fibrous spunbond material and one 22 gsm inner layer of white nonwoven fibrous spunbond material having the same width. Both layers of the nonwoven fibrous spunbond materials were made of polypropylene. The electret filter material was the standard filter material that is used in a 3M 8511 N95 respirator. The laminated web blank was cut into the 254 mm long pieces to form a square before being formed into a cup formation that mated with the support structure.

Other Respirator Components

Face seal: Standard 3M 4000 Series respirator face seal material.

Nose clip: Malleable plastically deformable aluminum strip having the shape shown in FIG. 4.

Headband: Standard 3M 8210 Plus N 95 Respirator headband material but white in color. The Yellow pigment for 3M 8210 Plus respirator headband was removed.

Respirator Assembly

The nose clip was bent into the inverted u-shape shown in FIGS. 1 and 2 to approximately match the shape of the mold cavity nose portion. The nose clip was then manually placed into the mold cavity, the mold halves were closed, and the molten polymeric material was injected into the support structure mold. The polymeric material encapsulated the nose clip ends and became mechanically bonded to the nose clip when the solidification occurred. The mold was then opened, and the support structure, with the nose clip bonded thereto, was removed.

The face seal material was cut to pieces that were about 140 mm by 180 mm. A die cut tool was then used to create an oval opening that was 125 mm by 70 mm and was located in the center of the face seal. The face seal with the central cut out opening was attached to respirator filtering structure made as described above. The same equipment that was used to ultrasonically weld the filtering element structure was used to secure the face seal to the filtering structure under similar process conditions. The welding anvil had an oval shape of about 168 mm wide and 114 mm long. After the face seal was joined to the filtering structure, excess material outside of the weld line was removed. Then the pre-assembled filtering element was inserted into the support structure with insert-molded nose clip in its desired orientation. A handheld Branson E-150 Ultrasonic welding equipment, at 100% output and 1.0 second weld time, was used to create attachment points between the support structure and the filtering structure at an interval of 20 to 25 mm along each transversely extending member. A 450 mm long braided headband material was threaded through the buckles to complete the respirator assembly process.

What is claimed is:

1. A filtering face-piece respirator that comprises:

(a) a harness; and (b) a mask body that comprises:

(i) a filtering structure;

(ii) a plastic support structure that includes a nose portion that has first and second converging members that define an opening; and (iii) a nose clip that has first and second ends and that is secured to the plastic support structure at the nose portion such that the nose clip is visible through the opening, the nose clip being secured to the plastic support structure by being molded thereabout at first and second ends.

2. The filtering face-piece respirator of claim 1, wherein the nose clip is plastically deformable and is secured to the mask body where the first and second converging members meet.

3. The filtering face-piece respirator of claim 1, wherein a central portion of the nose clip is visibly exposed.

4. The filtering face-piece respirator of claim 3, wherein the first and second converging members have a cross-sectional area of about 2 to 12 $mm^2$ and have a Stiffness in Flexure of about 75 to 300 MPa.

5. The filtering face-piece respirator of claim 3, wherein the nose clip is injection molded into the support structure at the first and second ends of the nose clip.

6. The filtering face-piece respirator of claim 5, wherein the nose clip comprises a means for improving a mechanical bond at the first and second ends of the nose clip.

7. The filtering face-piece respirator of claim 6, wherein the means for improving a mechanical bond includes notches, protrusions, roughened, coarse, and/or embossed surfaces and combinations thereof.

8. The filtering face-piece respirator of claim 5, wherein the first and second ends of the nose clip each have first and second notches located in opposing edges of the nose clip.

9. The filtering face-piece respirator of claim 1, wherein the nose clip comprises a malleable plastically deformable metal that has first and second ends, the first and second ends having discontinuities located therein or thereon to improve a mechanical bond to the plastic support structure that is molded thereabout.

10. The filtering face-piece respirator of claim 1, wherein the nose clip is made from metal and has a roughened or coarse exterior surface in the region where the plastic support structure is molded thereabout.

11. The filtering face-piece respirator of claim 1, wherein the nose clip comprises a material that is plastically deformable such that the nose clip can maintain its altered shape by resisting forces exerted thereon from members of the support structure after being deformed into the altered shape.

12. A method of making a filtering face-piece respirator mask body, which method comprises:

(a) providing a nose clip;

(b) insert molding a plastic support structure about at least part of the nose clip; and (c) joining a filtering structure to the plastic support structure;

wherein the support structure includes one or more members that define a perimeter, the support structure also having a nose portion that has an opening therein, the nose clip extending across the opening and being insert molded to the support structure at first and second ends of the nose clip.

13. The method of claim 12, wherein the nose clip comprises a linear strip of plastically deformable aluminum that has first and second ends, the plastic support structure being injection molded about the first and second ends.

14. The method of claim 13, wherein a central portion of the nose clip is visibly exposed.

15. The method of claim 12, wherein the resulting mask body has a curved nose portion, the provided nose clip having a precurved condition that generally matches the curvature of the curved nose portion.

16. A method of making a filtering face-piece respirator, which method comprises joining a harness to the mask body made according to the method of claim 12.

17. The method of claim 16, wherein the nose clip comprises a linear strip of malleable plastically deformable metal that has first and second ends, which ends each have discontinuities located therein or thereon, the plastic support structure being injection molded about the first and second ends.

18. The method of claim 16, wherein the plastic support structure is injection molded about at least part of the nose clip.

* * * * *